US012383001B1

(12) United States Patent
Van Noy et al.

(10) Patent No.: US 12,383,001 B1
(45) Date of Patent: Aug. 12, 2025

(54) PROTECTIVE GUARD WITH FLOATING KNEE PAD

(71) Applicant: Fox Head, Inc., Irvine, CA (US)

(72) Inventors: Ryan G. Van Noy, Costa Mesa, CA (US); Thanh T. Nguyen, Fountain Valley, CA (US); Jazmine M. DeGiacomo, Westminster, CA (US)

(73) Assignee: Fox Head, Inc., Irvine, CA (US)

( * ) Notice: Subject to any disclaimer, the term of this patent is extended or adjusted under 35 U.S.C. 154(b) by 0 days.

(21) Appl. No.: 18/756,863

(22) Filed: Jun. 27, 2024

(51) Int. Cl.
*A41D 13/06* (2006.01)

(52) U.S. Cl.
CPC ..... *A41D 13/065* (2013.01); *A41D 13/06* (2013.01)

(58) Field of Classification Search
CPC ..... A41D 13/065; A41D 13/06
See application file for complete search history.

(56) References Cited

U.S. PATENT DOCUMENTS 4,198,708 A * 4/1980 Fugere ..... A41D 13/065 2/24
4,250,578 A * 2/1981 Barlow ..... A41D 13/065 2/24
4,484,361 A * 11/1984 Leighton ..... A41D 13/065 2/24
4,870,956 A * 10/1989 Fatool ..... A61F 5/0109 602/26
5,452,475 A * 9/1995 Hunt, Jr. ..... A63B 71/1225 2/22
5,611,080 A * 3/1997 Skottheim ..... A41D 13/0568 2/22
5,634,211 A * 6/1997 Chen ..... A63B 71/1225 2/24
5,652,956 A * 8/1997 Hoshizaki ..... A63B 71/1225 2/22
7,237,270 B2 * 7/2007 Crye ..... A41D 13/0575 2/24
10,986,884 B2 4/2021 Cox
12,181,253 B2 * 12/2024 Roby ..... A41D 13/0512
2006/0026736 A1 * 2/2006 Nordt, III ..... A41D 13/05 2/125
2010/0192269 A1 * 8/2010 Saranga ..... A41D 13/0568 2/24
2012/0165713 A1 * 6/2012 Forbes ..... A61F 5/0109 602/26
2018/0125693 A1 * 5/2018 Best ..... A61F 5/0109
(Continued)

FOREIGN PATENT DOCUMENTS

EP 1613182 B1 11/2007

*Primary Examiner* — Khaled Annis
(74) *Attorney, Agent, or Firm* — Reed Smith LLP; Walter M. Egbert, III; Richard J. Brown

(57) ABSTRACT

A knee guard for protecting the knee of a wearer is provided including an inner sleeve that fits over the knee of the wearer covering at least front and left and right side portions of a leg of the wearer proximate the knee joint, a knee guard including an outer layer positioned over the inner sleeve proximate the knee joint and slidable with respect to the inner sleeve, the outer layer attached to the inner sleeve at left and right side portions above the knee joint and at left and right side portions below the knee joint, the outer layer not attached to the inner sleeve at the front portion adjacent the knee joint; and a protective pad secured to the outer layer and not secured to the inner sleeve and slidable with respect to the inner sleeve.

20 Claims, 11 Drawing Sheets

(56) References Cited

U.S. PATENT DOCUMENTS

| | | | | |
|---|---|---|---|---|
| 2019/0175377 | A1* | 6/2019 | Forbes | A61F 5/0109 |
| 2019/0364990 | A1* | 12/2019 | LaCroix | A41D 13/0543 |
| 2022/0053848 | A1 | 2/2022 | Matthews et al. | |
| 2022/0395035 | A1* | 12/2022 | Leone | A41D 13/08 |

* cited by examiner

PROTECTIVE GUARD WITH FLOATING KNEE PAD

FIELD OF TECHNOLOGY

The present disclosure generally relates to protective sports equipment, and more particularly to a knee or other type of guard that provide flexibility of the joint while maintaining protection of the joint.

BACKGROUND OF TECHNOLOGY

Outdoor activities such as mountain biking (MTB), also known as off-road cycling, are increasingly popular but also present a risk for injury. Riders navigate through terrain, such as footpaths, single-tracks, forest, unconventional urban, and mountainous area. The slippery and uneven surface of these routes usually consists of rocks, mud, dirt, and tree roots. Consequently, riders are vulnerable to injury to skin and underlying tissue injury due to trauma, mechanical friction, pressure, and the environment. Lacerations and abrasions are quite common among mountain bikers mainly due to direct trauma because of a fall or equipment failure. A rider's knees are generally one of the first—and most painful—parts of the body to hit the ground in a crash. As a result, management of skin trauma is commonly mandated for mountain bikers. A pair of knee pads is widely recognized as protection against such injury. Knee pads can protect the skin from abrasion and laceration wounds and from debris, such as dirt and soil pathogens, that may contact the skin and cause infection. What is needed is a knee guard that overcomes the disadvantages of conventional design.

SUMMARY OF DESCRIBED SUBJECT MATTER

Embodiments of the present disclosure include a knee guard for protecting the knee of a wearer including an inner sleeve that fits over the knee of the wearer covering at least front and left and right side portions of a leg of the wearer proximate the knee joint, a knee guard including an outer layer positioned over the inner sleeve proximate the knee joint and slidable with respect to the inner sleeve, the outer layer attached to the inner sleeve at left and right side portions above the knee joint and at left and right side portions below the knee joint, the outer layer not attached to the inner sleeve at the front portion adjacent the knee joint, and a protective pad secured to the outer layer and not secured to the inner sleeve and slidable with respect to the inner sleeve.

In some embodiments, the inner sleeve is fabricated from elastic fabric, such as Lycra®. In some embodiments, the outer layer is fabricated from an elastic fabric or a woven fabric such as Cordura®. In some embodiments, the protective pad is fabricated from an impact resistant material such as Koroyd™. In some embodiments, the knee protective insert is a pocket stitched to the outer layer, and the protective pad is disposed within the pocket. In some embodiments, a top and a bottom portion of the inner sleeve includes an elastic grip. In some embodiments, the outer layer is attached to the inner sleeve by stitches, adhesive or thermal bonding.

Embodiments of the present disclosure include a knee guard for protecting the knee of a wearer, having an inner sleeve that fits over the knee of the wearer covering at least front and left and right side portions of the leg of the wearer proximate the knee joint; a knee guard including an outer layer comprising a first portion positioned over the inner sleeve proximate the knee joint and at least partially slidable with respect to the inner sleeve, the first portion attached to the inner sleeve at left and right side portions above the knee joint, the first portion not attached to the inner sleeve at the front portion adjacent the knee joint; and a second portion positioned over the inner sleeve proximate the knee joint and at least partially slidable with respect to the inner sleeve, the second portion attached to the inner sleeve at left and right side portions below the knee joint, the second portion not attached to the inner sleeve at the front portion adjacent the knee joint, and the second portion not attached to the inner sleeve along a bottom edge extending from the left side to the right side below the knee joint; and a protective pad secured to the outer layer and not secured to the inner sleeve and slidable with respect to the inner sleeve.

Embodiments of the present disclosure include a joint protection device for protecting a joint of a wearer, having an inner sleeve that fits over the joint of the wearer covering at least the front and left and right side portions of a limb of the wearer proximate the joint, a joint guard including an outer layer positioned over the inner sleeve proximate the joint and slidable with respect to the inner sleeve, the outer layer attached to the inner sleeve at left and right side portions above the joint and at left and right side portions below the joint, the outer layer not attached to the inner sleeve at the front portion adjacent the joint; and a protective pad secured to the outer layer and not secured to the inner sleeve and slidable with respect to the inner sleeve.

In some embodiments, the joint is the knee joint or the elbow joint of the wearer. In some embodiments, the inner sleeve is fabricated from elastic fabric. In some embodiments, the outer layer is fabricated from elastic fabric or woven fabric. In some embodiments, the protective pad is fabricated from an impact resistant material such as Koroyd™. In some embodiments, the protective insert is a pocket stitched to the outer layer, and the protective pad is disposed within the pocket. In some embodiments, a top and a bottom portion of the inner sleeve includes an elastic grip. In some embodiments, the outer layer is attached to the inner sleeve by stitches, adhesive or thermal bonding.

BRIEF DESCRIPTION OF THE DRAWINGS

Various embodiments of the present disclosure can be further explained with reference to the attached drawings, wherein like structures are referred to by like numerals throughout the several views. The drawings shown are not necessarily to scale, with emphasis instead generally being placed upon illustrating the principles of the present disclosure. Therefore, specific structural and functional details disclosed herein are not to be interpreted as limiting, but merely as a representative basis for teaching one skilled in the art to variously employ one or more illustrative embodiments.

DETAILED DESCRIPTION

Figure 1:
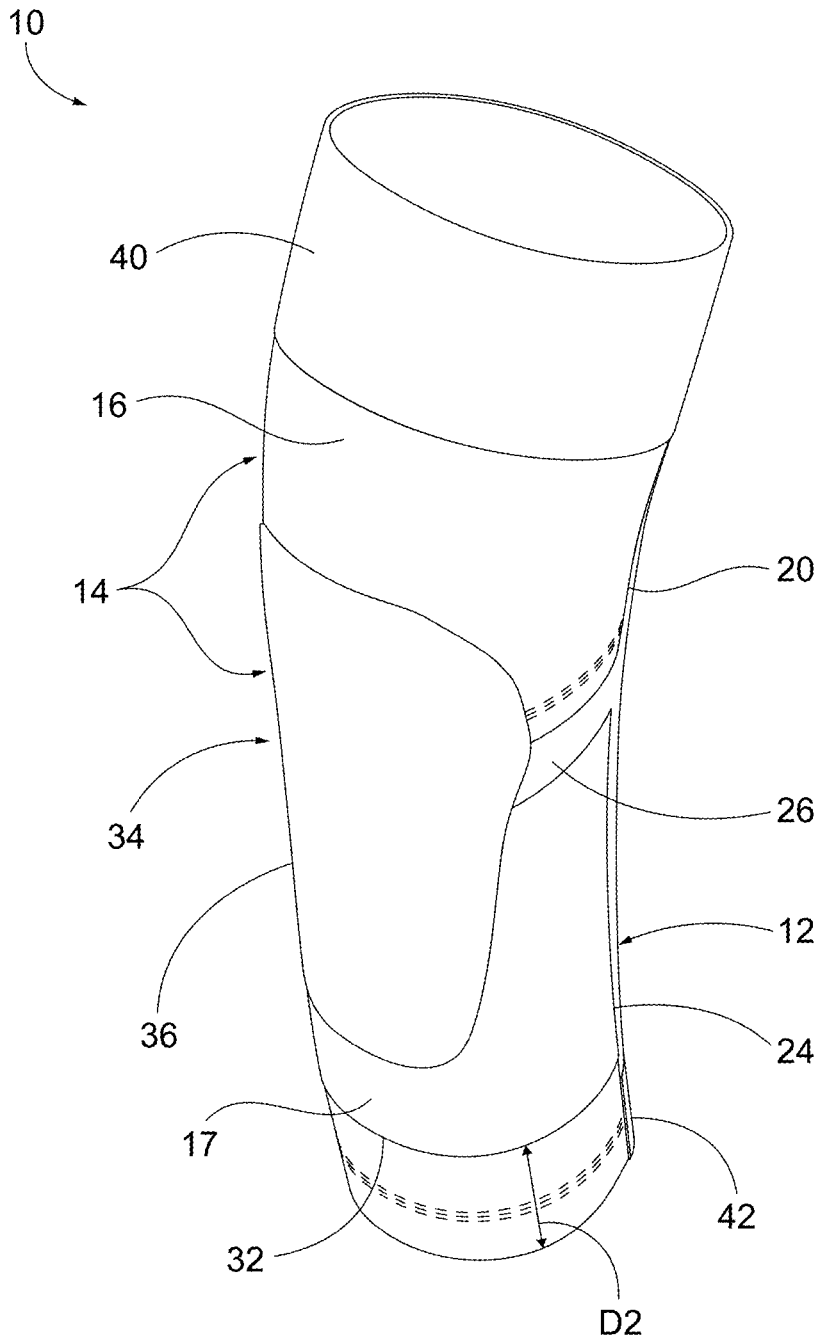
FIG. 1 is a front top front right side isometric view of the protective guard in accordance with exemplary embodiments of the disclosed subject matter.

Various detailed embodiments of the present disclosure, taken in conjunction with the accompanying figures, are disclosed herein; however, it is to be understood that the disclosed embodiments are merely illustrative. In addition, each of the examples given in connection with the various embodiments of the present disclosure is intended to be illustrative, and not restrictive.

Throughout the specification, the following terms take the meanings explicitly associated herein, unless the context clearly dictates otherwise. The phrases "in one embodiment" and "in some embodiments" as used herein do not necessarily refer to the same embodiment(s), though it may. Furthermore, the phrases "in another embodiment" and "in some other embodiments" as used herein do not necessarily refer to a different embodiment, although it may. Thus, as described below, various embodiments may be readily combined, without departing from the scope or spirit of the present disclosure.

In addition, the term "based on" is not exclusive and allows for being based on additional factors not described, unless the context clearly dictates otherwise. In addition, throughout the specification, the meaning of "a," "an," and "the" include plural references. The meaning of "in" includes "in" and "on."

As used herein, the terms "and" and "or" may be used interchangeably to refer to a set of items in both the conjunctive and disjunctive in order to encompass the full description of combinations and alternatives of the items. By way of example, a set of items may be listed with the disjunctive "or", or with the conjunction "and." In either case, the set is to be interpreted as meaning each of the items singularly as alternatives, as well as any combination of the listed items.

As used herein, the term "top" or "upper" portion refers to the portion of the guard closest to the body of the wearer. In the case of a knee guard, the "top" or "upper" portion refers to the thigh portion of the wearer's leg. Conversely, the term "bottom" or "lower" portion refers to the portion of the guard furthest from the body of the wearer. In the case of a knee guard, the "bottom" or "lower" portion refers to the calf portion of the wearer's leg. The term "front" refers to the region closest to the joint, such as the knee cap. The term "rear" refers to the region opposite the front. The "left" and "right" sides refer to the sides of the guard. The term "longitudinal" refers to an axis extending generally from the top of the guard to the bottom.

FIGS. 1-10 illustrate an exemplary protective guard 10 for protecting the knee of a wearer. Although one guard is shown in the figures, it is understood that the guard for the right and the left legs are substantially identical and/or mirror images. Further, it is understood that the protective guard described herein can also be used to protect other joints of the user, such as the elbow or wrist. The protective guard includes an inner sleeve 12 that surrounds the limb and a floating joint guard 14 that is at least partially slidable over the inner sleeve 12 and maintains position over the joint during flexion and extension of the joint. Consequently, maximum protection of the joint is maintained.

Figure 2:
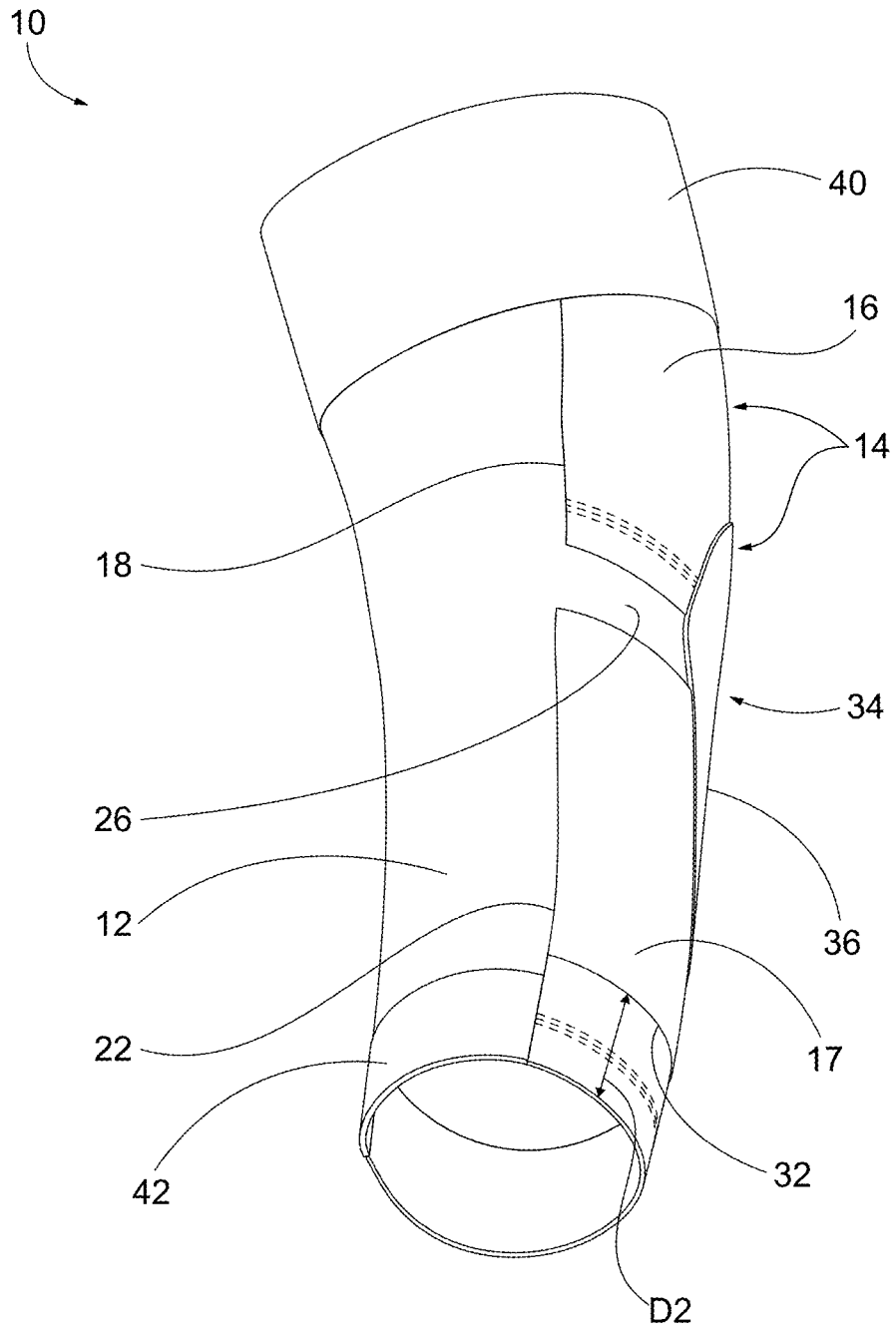
FIG. 2 is a bottom rear left side isometric view thereof.
Figure 3:
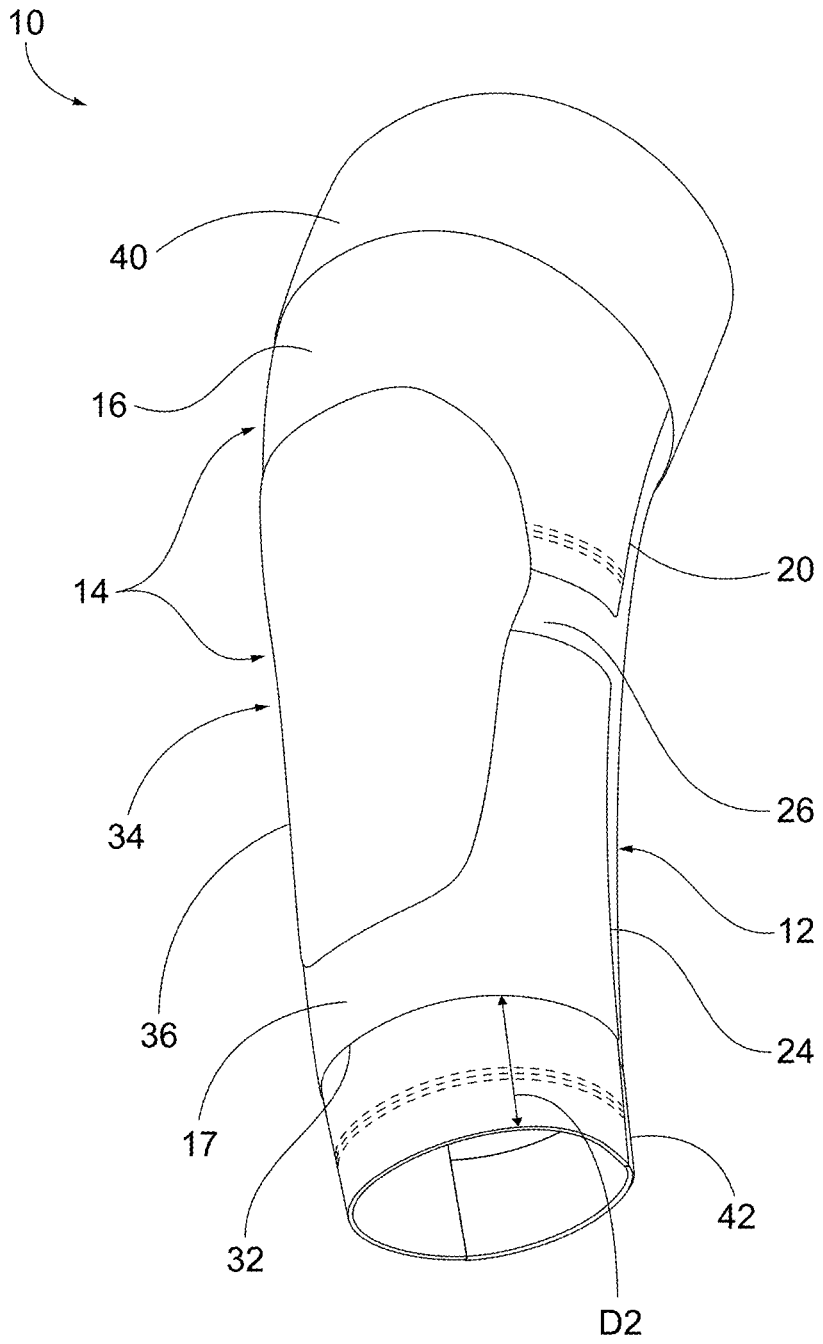
FIG. 3 is a bottom front right side view thereof.
Figure 4:
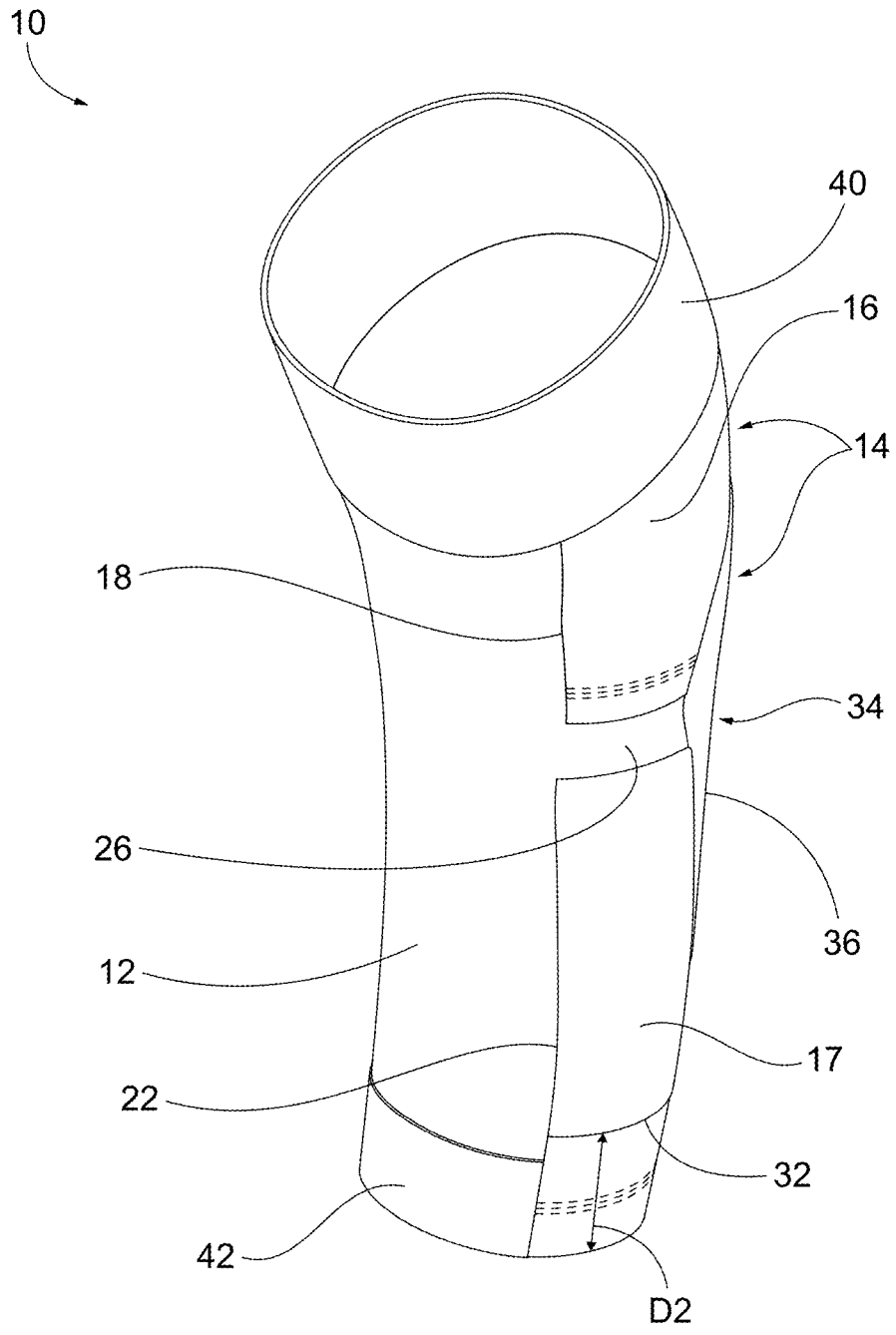
FIG. 4 is a top rear left side view thereof.
Figure 5:
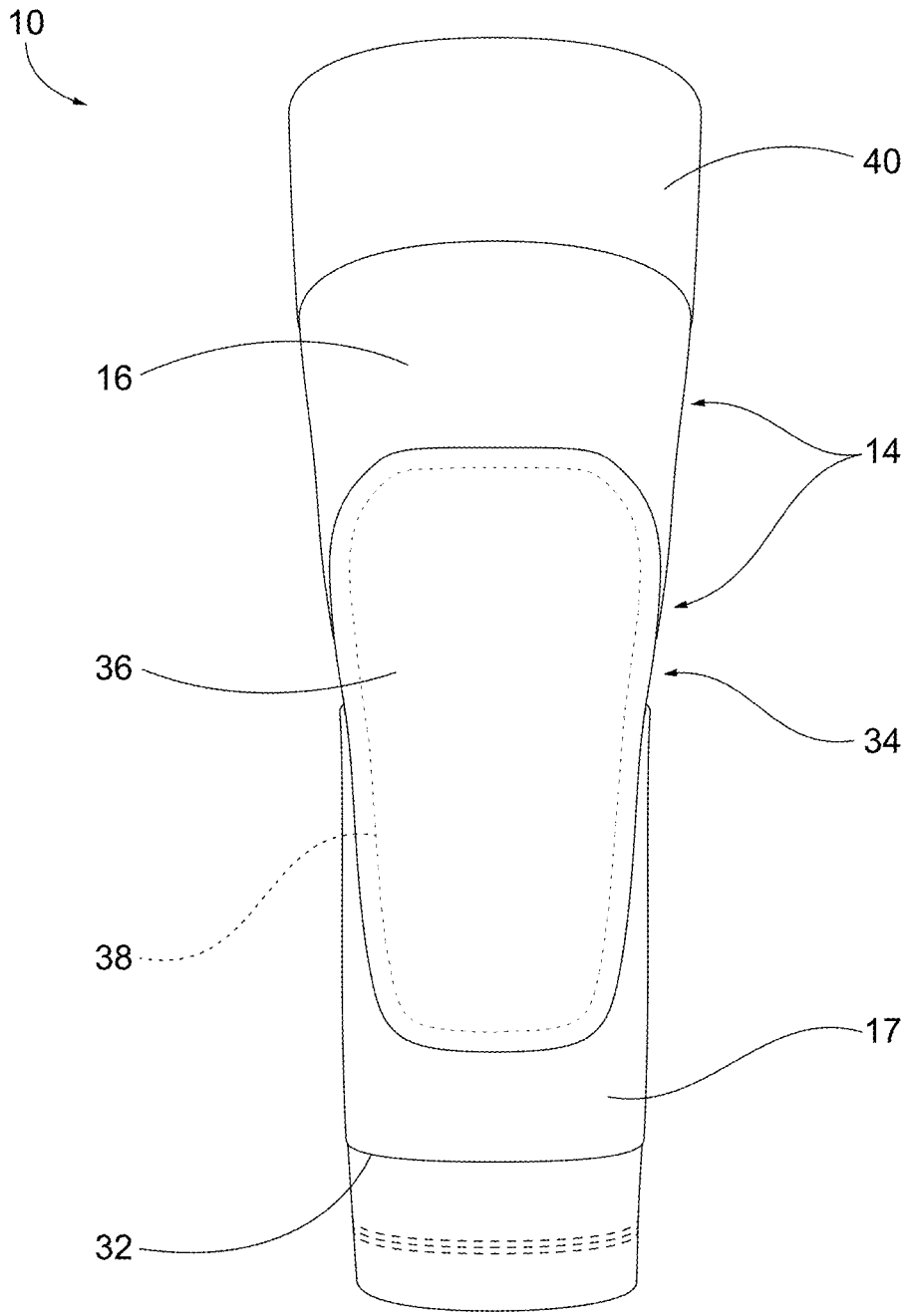
FIG. 5 is a front elevation view thereof.
Figure 6:
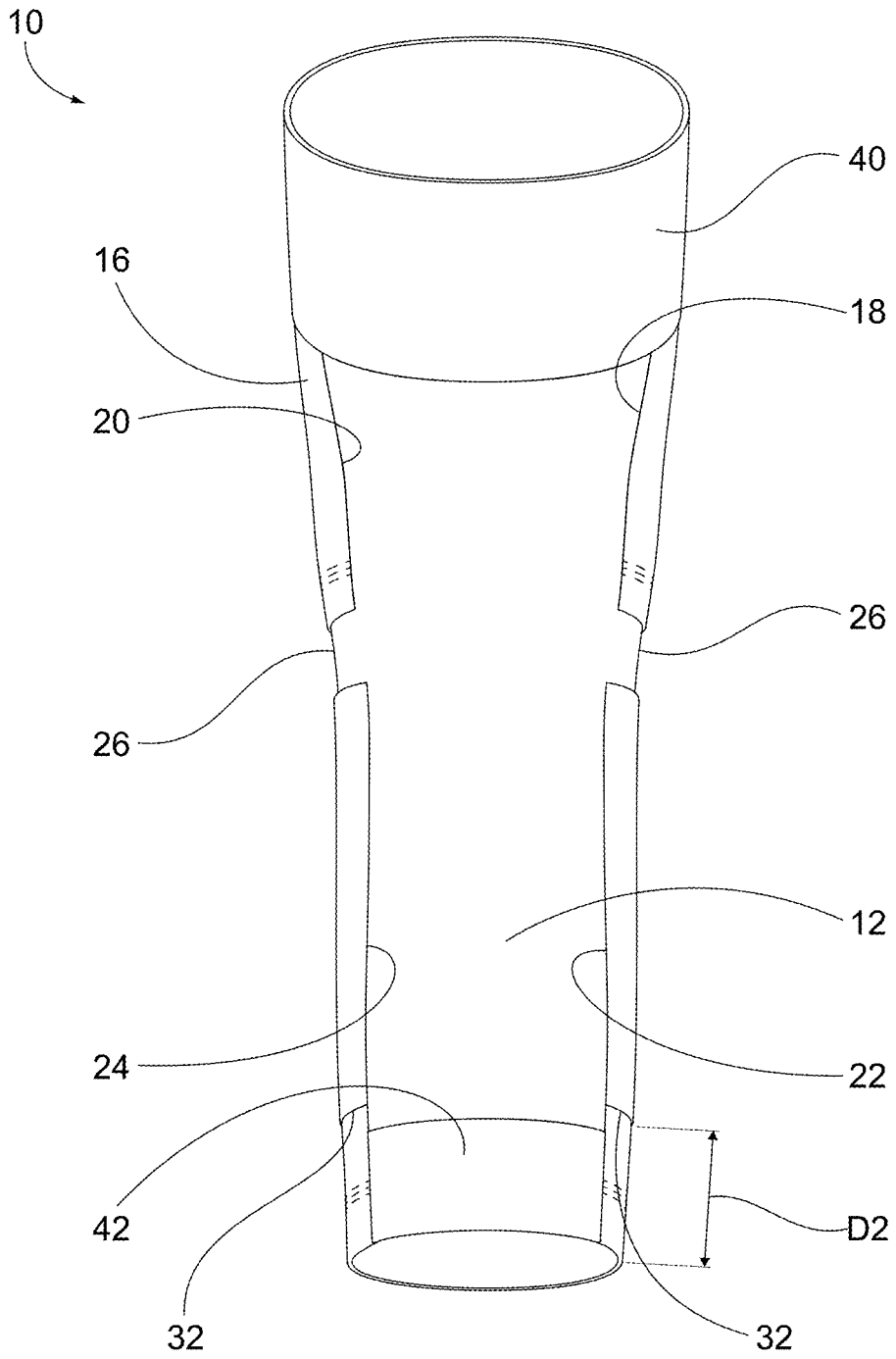
FIG. 6 is a rear elevation view thereof.
Figure 7:
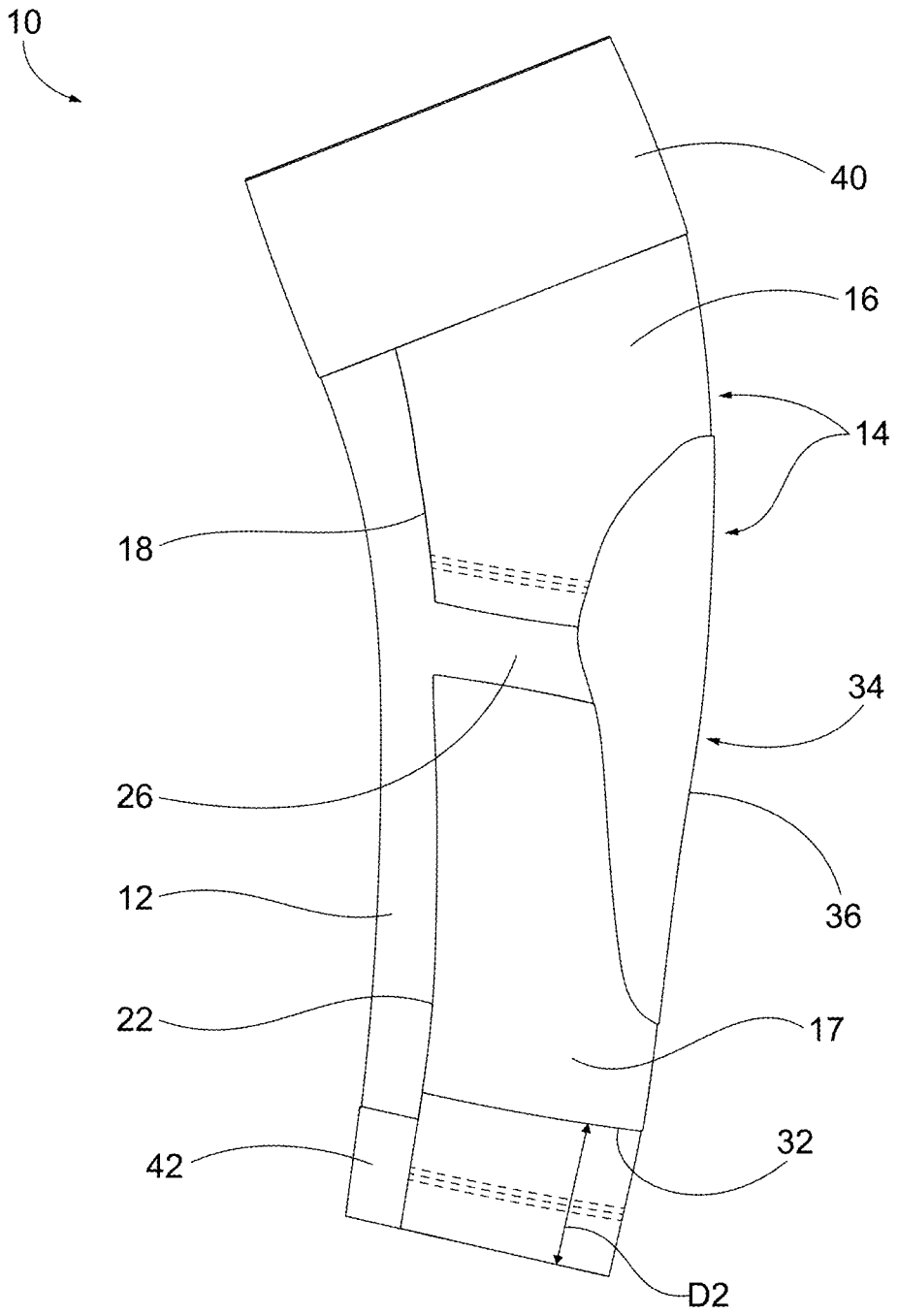
FIG. 7 is a left side elevation view thereof.
Figure 8:
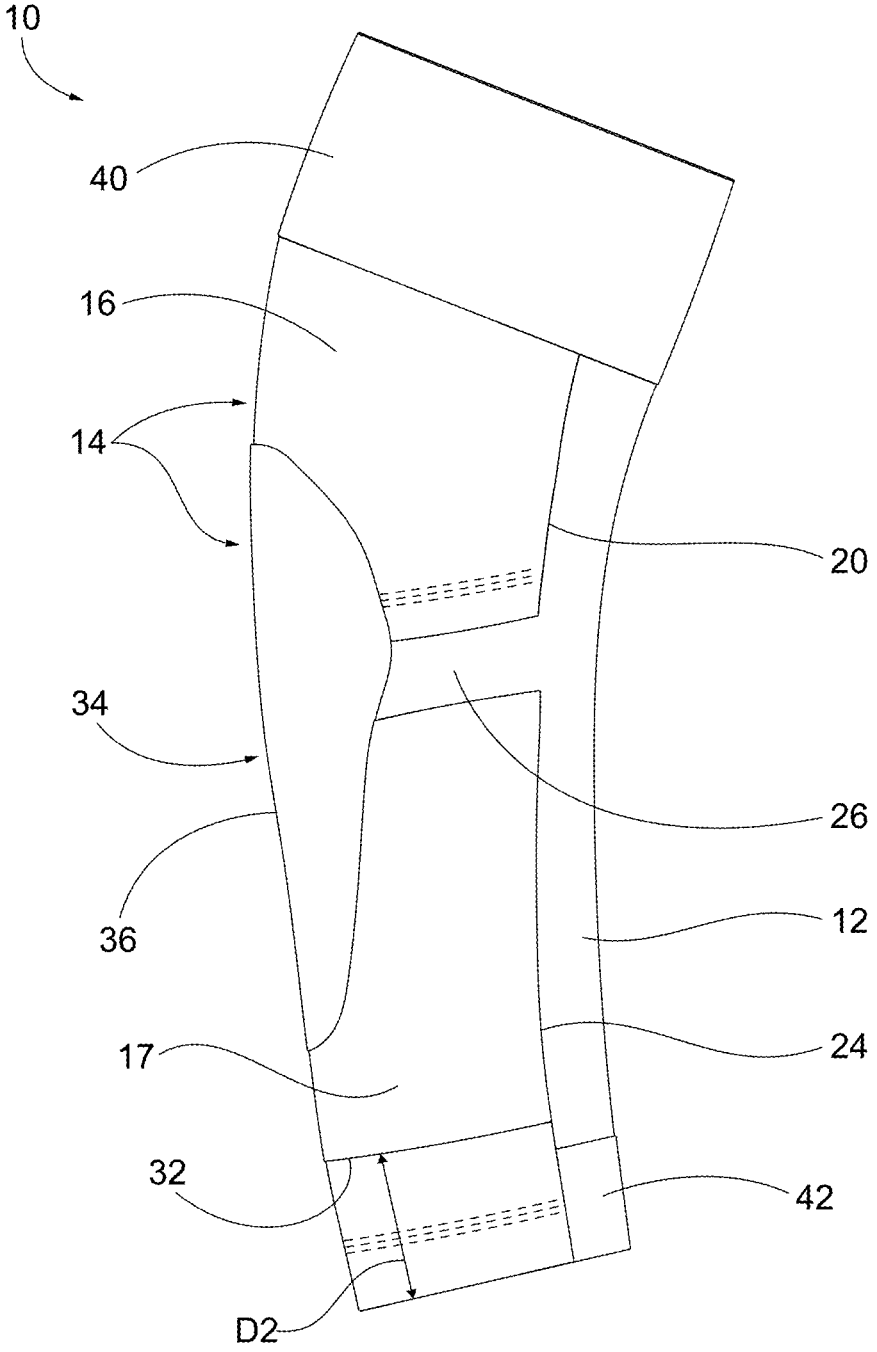
FIG. 8 is a right side elevation view thereof.
Figure 9:
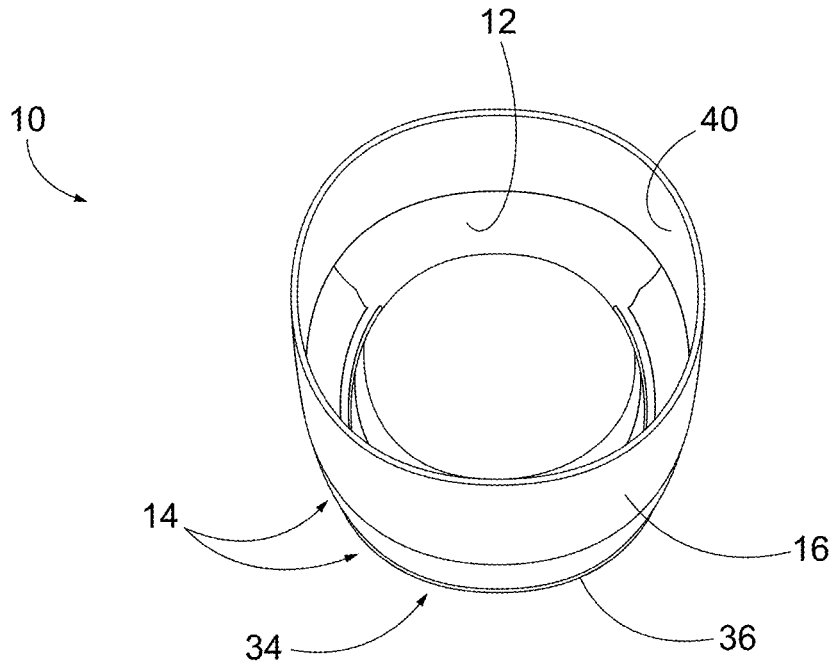
FIG. 9 is a top plan view thereof.
Figure 10:
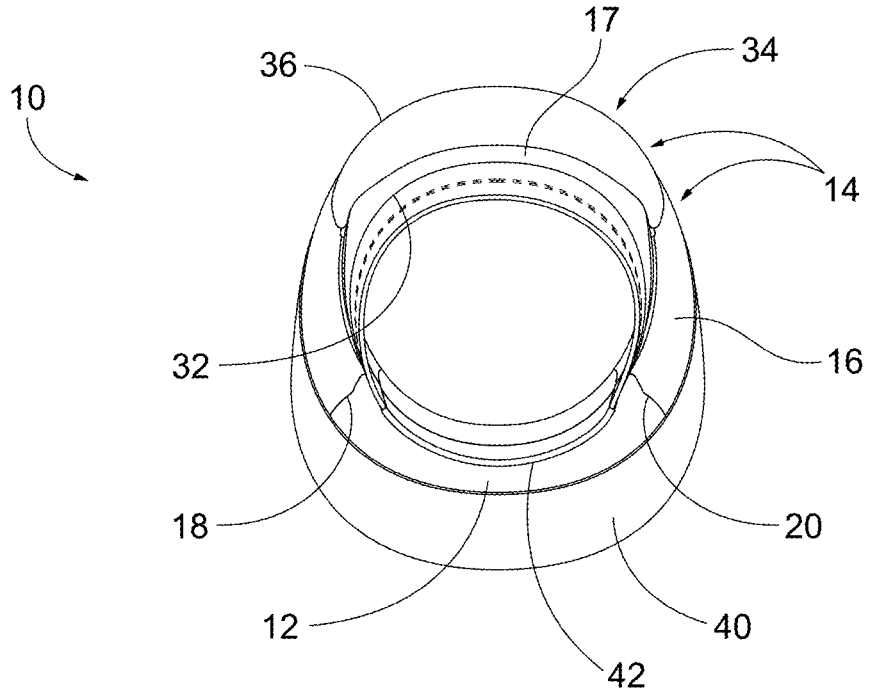
FIG. 10 is a bottom plan view thereof.

The inner sleeve 12 is typically a cylindrical or near-cylindrical sleeve that fits snugly over the knee of the wearer. In some embodiments, the inner sleeve 12 is fabricated from an elastic synthetic fabric such as elastane or Lycra®, or similar stretchable material. The inner sleeve 12 covers at least the front and left and right side portions of a leg of the wearer at the knee joint and extending above and below the knee joint. In some embodiments, the inner sleeve 12 also covers the back portion of the leg, as illustrated in FIGS. 2, 4 and 6.

A knee guard 14 is positioned over the inner sleeve 12 proximate the knee joint and is at least partially slidable, e.g., "floating," with respect to the inner sleeve 12. In some embodiments, the knee guard 14 includes a protective pad 34 and an outer layer having an upper portion 16 and a lower portion 17. In some embodiments, a single piece of the material comprises the upper portion 16 and the lower portion 17. In some embodiments, the upper portion 16 is fabricated from an elastic synthetic fabric such as elastane or Lycra®, or similar stretchable material. The upper portion 16 is attached to the inner sleeve 12 at a left side portion 18 and at a right side portion 20 above the knee joint, but is not attached at the front portion of the leg. The upper portion 16 is secured to the inner sleeve 12 by the use of stitches along a seam that runs substantially longitudinally. Alternatively, the upper portion 16 is secured by thermal compression, adhesive, or the like. Similarly, the lower portion 17 is attached at a left side portion 22 and at a right side portion 24 below the knee joint but is not attached to the inner sleeve at the front portion. In some embodiments, the lower portion 17 is fabricated from a high tenacity woven nylon or polyester fabric such as Cordura® material (or similar material). As will be described in greater detail herein, the front portions of the upper portion 16 and lower portion 17 are slidable over the inner sleeve 12 during extension and flexion of the knee. The bottom portion 32 of the lower portion 17 is not attached to inner sleeve 12 and slidable with respect to inner sleeve 12.

The knee guard 14 further includes a protective pad 34 configured to be positioned over the knee joint of the wearer when worn by the wearer. The protective pad 34 is secured to the upper portion 16 at a top portion thereof and to the lower portion 17 at a bottom portion thereof. The protective pad 34 is not attached to the inner sleeve 12. A gap 26 is defined adjacent the knee joint at each side of the wearer's leg. In some embodiments, protective pad 34 includes a pocket or case 36 fabricated from a high tenacity woven nylon or polyester fabric such as Cordura® material (or similar material) and a cushion insert 38 secured within the pocket 36. The pocket 36 is in turn secured to the upper portion 16 and lower portion 17 by stitches, thermal bonding, adhesive and the like. In some embodiments, the insert 38 is fabricated from material having strength and energy dissipation properties to protect to knee from impact. Exemplary materials include a Koroyd™ material having a network or welded co-polymer tubes. Other cushion materials include D30™, Poron™ and other recycled and non recycled closed cell foams. As will be described in greater detail herein, the protective pad 34 is slidable over the inner sleeve 12 during extension and flexion of the knee.

In some embodiments, the guard 10 includes a top elastic grip 40 positioned at the top portion of the guard 10 and a bottom elastic grip 42 positioned at a bottom portion of the guard 10. The top clastic grip 40 and bottom elastic grip 42 are fabricated from materials such as elastic, spandex, and lycra in combination with silicon gripper.

Figure 11:
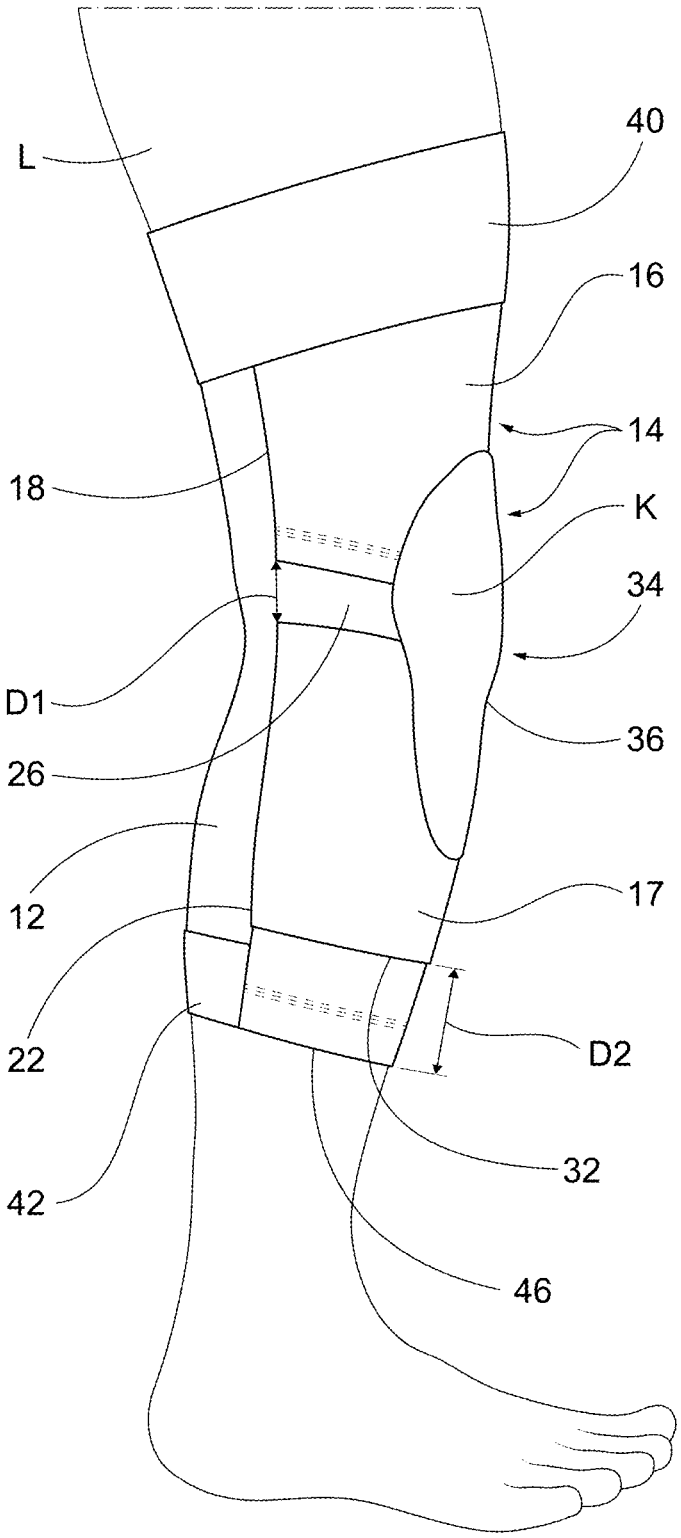
FIG. 11 is a side of view of the protective guard as worn by a wearer illustrating knee extension.

FIG. 11 illustrates the guard 10 as worn by the wearer on the leg L in a knee extension position. The protective pad 34 is positioned over the wearer's knee K when in the knee extension position. As can be seen in FIG. 11, a distance D1 is defined in the gap 26 between the upper portion 16 and the lower portion 17. A distance D2 is defined between the bottom edge 32 of the lower portion 17 and the bottom edge 46 of the guard 10.

Figure 12:
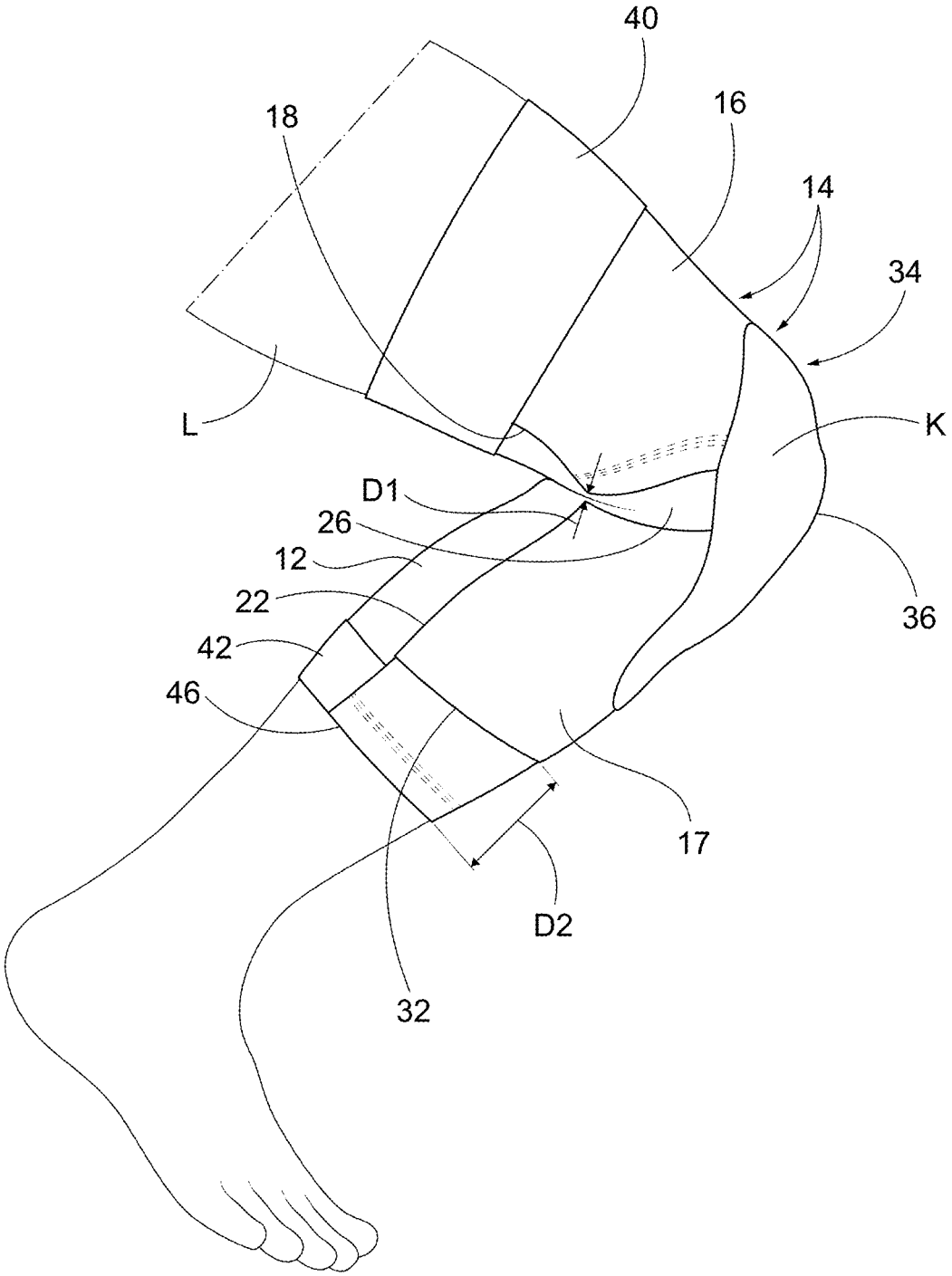
FIG. 12 is a side of the protective guard as worn by a wearer illustrating knee flexion.

FIG. 12 illustrates the guard 10 as worn by the wearer in the knee flexion position. Since the outer layer 16/17 and the knee guard 14 are not secured to the inner layer 12 at the front of the leg adjacent the knee, the knee guard 14 is slidable with respect to the inner layer 12. Thus, when the knee flexes, the knee guard 14 remains positioned over the knee K. When compared to knee extension position (FIG. 11), the distance D1 between the upper portion 16 and the lower portion 17 is reduced. Likewise, when compared to the knee extension position, the distance D2 between the bottom edge 32 of the lower portion 17 and the bottom edge 46 of the guard 10 becomes longer.

While one or more embodiments of the present disclosure have been described, it is understood that these embodiments are illustrative only, and not restrictive, and that many modifications may become apparent to those of ordinary skill in the art.

The invention claimed is:

1. A protective guard for protecting a knee of a wearer, comprising:

an inner sleeve configured to fit over the knee of the wearer covering at least front and left and right side portions of a leg of the wearer proximate the knee joint;

a knee guard comprising an outer layer disposed over the inner sleeve and configured to be positioned proximate the knee joint comprising a first portion at least partially slidable with respect to the inner sleeve, attached to the inner sleeve at left and right side portions above the knee joint and not attached to the inner sleeve at the front portion adjacent the knee joint;

a second portion at least partially slidable with respect to the inner sleeve, the second portion attached to the inner sleeve at left and right side portions below the knee joint, and not attached to the inner sleeve at the front portion adjacent the knee joint along a bottom edge extending from the left side to the right side below the knee joint; wherein the first portion and the second portion are separated by a gap between the respective left and right side portions; and a protective pad secured to the outer layer and not secured to the inner sleeve and slidable with respect to the inner sleeve.

2. The protective guard of claim 1, wherein the inner sleeve is fabricated from elastic fabric.

3. The protective guard of claim 1, wherein the outer layer is fabricated from elastic fabric or woven fabric.

4. The protective guard of claim 1, wherein the protective pad comprises an insert fabricated from an impact resistant material.

5. The protective guard of claim 4, wherein the protective pad comprises a pocket secured to the outer layer, and wherein the insert is disposed within the pocket.

6. The protective guard of claim 1, wherein at least one of a top portion and a bottom portion of the inner sleeve comprise an elastic grip.

7. The protective guard of claim 1, wherein the outer layer is attached to the inner sleeve by the use of stitches, adhesive or thermal bonding.

8. A knee guard for protecting a knee of a wearer, comprising:

an inner sleeve configured to fit over the knee of the wearer covering at least front and left and right side portions of the leg of the wearer proximate the knee joint;

a knee guard comprising an outer layer disposed over the inner sleeve and configured to be positioned proximate the knee joint comprising a first portion disposed over the inner sleeve proximate the knee joint and at least partially slidable with respect to the inner sleeve, the first portion attached to the inner sleeve at left and right side portions above the knee joint, the first portion not attached to the inner sleeve at the front portion adjacent the knee joint;

a second portion positioned over the inner sleeve proximate the knee joint and at least partially slidable with respect to the inner sleeve, the second portion attached to the inner sleeve at left and right side portions below the knee joint, the second portion not attached to the inner sleeve at the front portion adjacent the knee joint, and the second portion not attached to the inner sleeve along a bottom edge extending from the left side to the right side below the knee joint; and a protective pad secured to the outer layer and not secured to the inner sleeve and slidable with respect to the inner sleeve.

9. The knee guard of claim 8, wherein the inner sleeve is fabricated from elastic fabric.

10. The knee guard of claim 8, wherein the outer layer is fabricated from elastic fabric or woven fabric.

11. The knee guard of claim 8, wherein the protective pad comprises an insert fabricated from an impact resistant material.

12. The knee guard of claim 11, wherein the protective pad comprises a pocket secured to the outer layer, and wherein the insert is disposed within the pocket.

13. The knee guard of claim 8, wherein at least one of a top portion and a bottom portion of the inner sleeve comprise an elastic grip.

14. The knee guard of claim 8, wherein the outer layer is attached to the inner sleeve by the use of stitches, adhesive or thermal bonding.

15. A joint protection device for protecting a joint of a wearer, comprising:

an inner sleeve configured to fit over the joint of the wearer covering at least front and left and right side portions of a limb of the wearer proximate the joint;

a joint guard comprising an outer layer disposed over the inner sleeve and configured to be positioned proximate the joint and slidable with respect to the inner sleeve, the outer layer attached to the inner sleeve at left and right side portions above the joint and at left and right side portions below the joint, the outer layer not attached to the inner sleeve at the front portion so that a distance between a bottom edge of the outer layer and a bottom edge of the inner sleeve is configured to increase when the joint moves from an extension position to a flexion position; and a protective pad secured to the outer layer and not secured to the inner sleeve and slidable with respect to the inner sleeve.

16. The joint protective device of claim 15, wherein the joint is a knee joint of the wearer.

17. The joint protective device of claim 15, wherein the inner sleeve is fabricated from elastic fabric.

18. The joint protective device of claim 15, wherein the outer layer is fabricated from woven fabric or elastic fabric.

19. The joint protective device of claim 15, wherein the protective pad comprises an insert fabricated from an impact resistant material.

20. The joint protective device of claim 19, wherein the protective pad comprises a pocket secured to the outer layer, and wherein the insert is disposed within the pocket.

* * * * *